United States Patent [19]

Hayata et al.

[11] Patent Number: 4,896,597

[45] Date of Patent: Jan. 30, 1990

[54] SCREEN PRINTING APPARATUS

[75] Inventors: Shoji Hayata, Ibaragi; Tadao Watanabe, Ichikawa, both of Japan

[73] Assignee: Riso Kagaku Corporation, Tokyo, Japan

[21] Appl. No.: 158,175

[22] Filed: Feb. 19, 1988

[30] Foreign Application Priority Data

Feb. 20, 1987 [JP] Japan ..... 62-22687[U]
Feb. 20, 1987 [JP] Japan ..... 62-22688[U]

[51] Int. Cl.[4] ..... B41F 15/14
[52] U.S. Cl. ..... 101/126; 101/128.21
[58] Field of Search ..... 101/126, 127, 127.1, 101/128.4, 128.21

[56] References Cited

U.S. PATENT DOCUMENTS

| | | | |
|---|---|---|---|
| 390,430 | 10/1888 | Zimmer | 101/126 |
| 479,968 | 8/1892 | Wise | 101/126 |
| 540,862 | 6/1895 | Klaber | 101/126 |
| 1,495,037 | 5/1924 | Patterson | 101/126 |
| 1,502,810 | 7/1924 | Di Cossimo | 101/126 |
| 1,533,700 | 4/1925 | Dibble et al. | 101/126 |
| 4,509,420 | 4/1985 | Staffolino | 101/126 X |
| 4,753,164 | 6/1988 | Barry et al. | 101/126 |

FOREIGN PATENT DOCUMENTS

| | | | |
|---|---|---|---|
| 63-25173 | 7/1988 | Japan | 101/126 |

*Primary Examiner*—Clifford D. Crowder
*Attorney, Agent, or Firm*—Kanesaka and Takeuchi

[57] ABSTRACT

A screen printing apparatus has a holder for a printing plate which includes a screen master composed of a thermoplastic synthetic resin film and a porous screen stuck together and an inner frame attached to the screen master on its film side. The holder includes a lower outer frame for supporting the printing plate on its inner frame side, and an upper outer frame pivotally movable relative to the lower outer frame for pressing the printing plate against the lower outer frame so as to clamp the inner frame between the upper and lower outer frames. The upper outer frame has a downwardly bent inner peripheral edge for pushing the screen master from its screen side as the printing plate is held between the upper and lower outer frames.

11 Claims, 4 Drawing Sheets

SCREEN PRINTING APPARATUS

BACKGROUND OF THE INVENTION

1. Field of the Invention

The present invention relates to a screen printing apparatus using a heat-sensitive screen master.

2. Description of the Prior Art

In the heat-sensitive screen printing, it is known to use a printing plate 5 which includes a screen master 3 (FIG. 6 of the accompanying drawings) composed of a thermoplastic synthetic resin film 1 and a porous screen 2 stuck together, and a centrally opening frame 4 (FIG. 5) attached to the screen master 3 on its screen side so as to stretch the screen master 3 with an appropriate degree of tension. For plate-making or stencil-making, as shown in FIG. 7, an original 6 with its picture or image side down is placed on the thermoplastic synthetic resin film 1 of the printing plate 5, and then the printing plate 5 is set on a plate or stencil making apparatus 7 in such a manner that the frame 4 of the printing plate 5 contacts a transparent support 8 of the stencil making apparatus 7. Subsequently, the screen master 3 and the original 6 are pressed by a pressure pad 9 against the transparent support 8 so as to tightly contact each other, whereupon light from a light source 10 is irradiated to the screen master 3. As a result, the exposed areas of the original 6 are formed to appear as an image in pores on the thermoplastic synthetic resin film 1 of the screen master 3. The thus processed printing plate 5 is used as a stencil. For printing, as shown in FIG. 8, the processed printing plate 5 with its screen side up is placed on a print paper 11 supported on a table (not shown), and an amount of ink 12 is spread by a squeegee 13 over the screen 2 within the frame 4.

However, a primary problem with such prior art is in that it is difficult or requires a well-experienced workperson to attach the frame 4 to the screen master 3 so as to impart thereto an appropriate degree of tension. If the screen master 3 could not be tightly stretched by the frame 4, such screen master 3 would easily become relaxed when it is depressed toward the transparent support 8 by the pressure pad 9. This is true because the screen master 3 must be depressed from the position of FIG. 7 in which it is spaced from the transparent support 8 by a distance equal to the thickness of the frame 4. When the ink 12 is spread over this relaxed screen master 3 by the squeegee 13, a shear in printing would occur and hence an objectionably elongated or warped image would appear on the print paper 11.

SUMMARY OF THE INVENTION

It is therefore an object of the present invention to provide a screen printing apparatus in which a printing plate can be held in such a manner that a screen master is stretched with an appropriate degree of tension.

According to the present invention, a screen printing apparatus is designed to print a printing plate including a screen master composed of a thermoplastic synthetic resin film and a porous screen stuck together, and an inner frame attached to the screen master on its film side. The screen printing apparatus comprises a base having a central portion where an object on which a print is to be made is to be received; a lower outer frame mounted on the base for supporting the printing plate on its inner-frame side; and an upper outer frame pivotally mounted on the base for pressing the printing plate against the lower outer frame so as to clamp the inner frame between the upper and lower outer frames. The upper outer frame has a downwardly bent inner peripheral edge for pushing the screen master from its screen side as the printing plate is held between the upper and lower outer frames.

Other objects and features of the invention will become apparent to those skilled in the art as the disclosure is made in the following description of a preferred embodiment of the invention.

DETAILED DESCRIPTION OF PREFERRED EMBODIMENT

Figure 3:
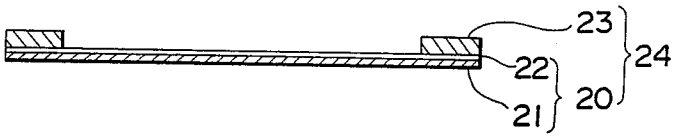
FIG. 3 is a cross-sectional view of the printing plate.

FIG. 3 shows a printing plate 24 for use in plate-making or stencil-making and also for use in screen printing. The printing plate 24 includes a heat-sensitive screen master 20 composed of a porous screen 21, such as of nylon or Tetoron (tradename of polyethylene terephthalate), and a thermoplastic synthetic resin film 22, such as of polyester or polypropylene, vinylidene chloride-vinyl chloride copolymer. The screen 21 and the film 22 are stuck together in laminated form. An inner frame 23, such as of a relatively thick sheet of paper, synthetic paper or plastic, or of a thin sheet of metal, is attached to the screen master 20 on its film side.

Figure 4:
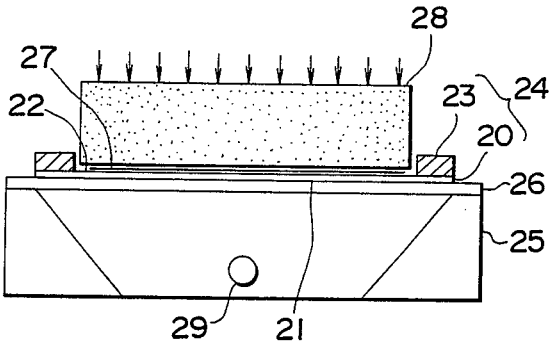
FIG. 4 illustrates a plate-making or stencil-making step.
Figure 5:
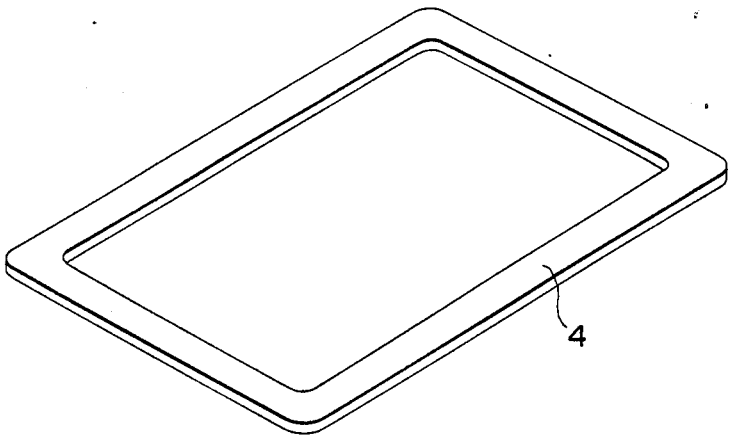
FIG. 5 PRIOR ART
FIG 5 is a perspective view of an inner frame of the printing plate.
Figure 6:
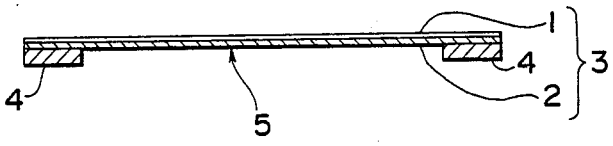
FIG. 6 PRIOR ART
FIG. 6 is a cross-sectional view of a prior art printing plate.
Figure 7:
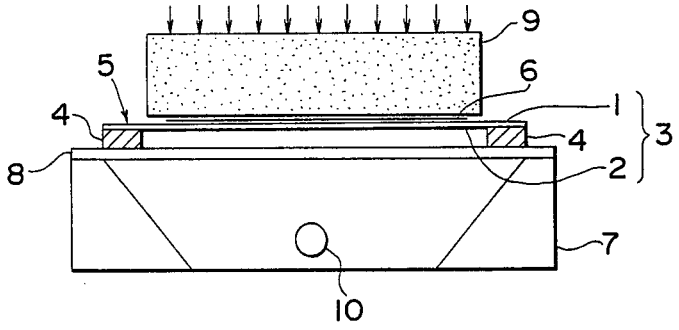
FIG. 7 PRIOR ART
FIG. 7 illustrates a prior art plate-making or stencil-making step.
Figure 8:
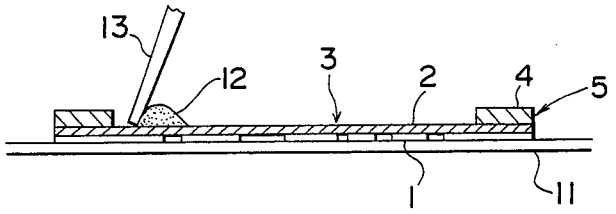
FIG. 8 PRIOR ART
FIG. 8 illustrates a prior art printing step.

For plate-making or stencil-making, as shown in FIG. 4, the printing plate 24 is set on a plate-making or stencil-making apparatus 25 in such a manner that the entire surface of the screen 22 of the screen master 20 closely contacts the transparent support 26. In this posture, both the inner frame 23 and the thermoplastic synthetic resin film 22 face upwardly. Then an original 27 having a picture or image usually formed of carbon is placed on the thermoplastic synthetic resin film 22 of the screen master 20 with picture side down. Subsequently the screen master 20 and the original 27 are pressed by a pressure pad 28 against the transparent support 26 so as to tightly contact with each other, whereupon light from a light source 29 is irradiated to the screen master 20. As the light reaches the original 27 through the screen master 20, carbon of the picture of the original 27 absorbs the heat energy to produce heat. Due to this heat, the picture of the original 27 is formed to appear as an image in pores on the thermoplastic synthetic resin film 22 of the screen master 20 which is used as a stencil in subsequent screen printing described below.

Figure 1:
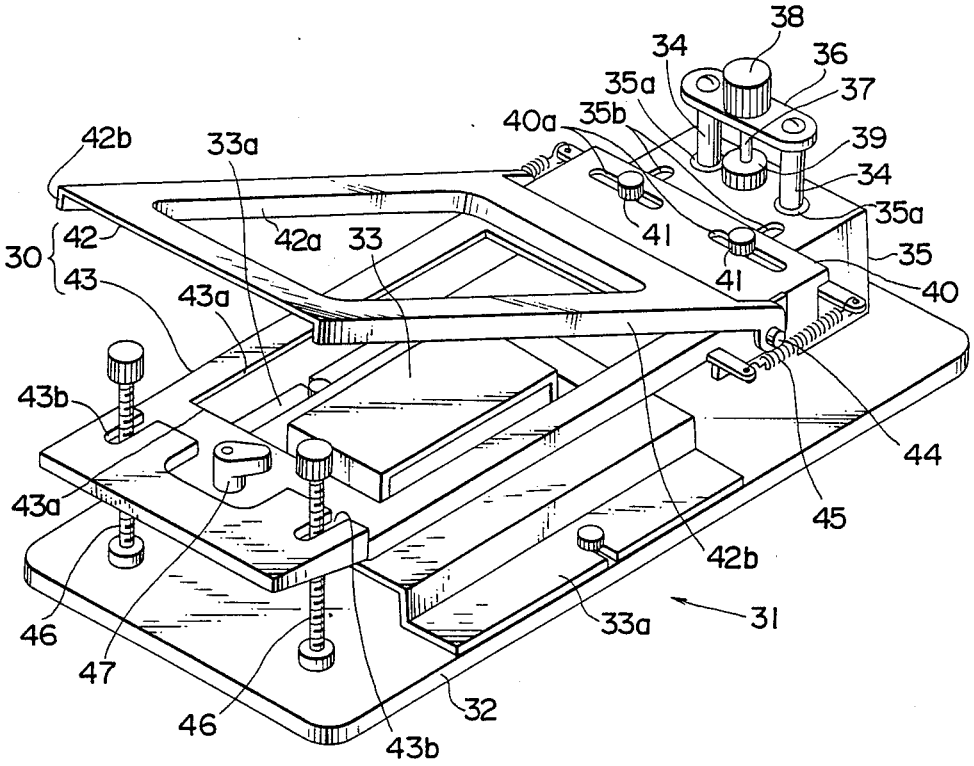
FIG. 1 is a perspective view of a screen printing apparatus embodying the present invention.

FIG. 1 shows a screen printing apparatus 31 (hereinafter called "printing apparatus"). The printing apparatus 31 generally comprises a base 32 and a holder 30 ajustably mounted on the base 32 for holding the processed printing plate 24. A support table 33 is placed substantially centrally on the base 32 for supporting an object in the form of a sheet on which the image of the original is to be printed. The support table 33 is clamped by a pair of brackets 33*a*, 33*a* adjustably mounted on the base 32. If the object on which a print is to be made is in the form of a solid having a considerable height, the support table 33 may be omitted, and the object may be placed directly on the base 32 and clamped by the brackets 33*a*, 33*a*.

A pair of upright posts 34, 34 is mounted on a front end portion of the base 32 and respectively extends through a pair of guide holes 35*a*, 35*a* in a slide 35 so that the latter is vertically movable along the guide posts 34, 34. A bridge plate 36 is mounted on and between the upper ends of the two posts 34, 34. An adjusting screw 37 is rotatably supported between the central portion of the bridge plate 36 and the base 32 for adjusting the height of the slide 35. The adjusting screw 37 threadedly extends through a non-illustrated nut fixed to the slide 35 so that the latter is vertically movable as the adjusting screw 37 is rotated by turning an adjusting knob 38 fixed to the upper end of the adjusting screw 37. Designated by 39 is a retainer nut threadedly mounted on the adjusting screw 37 for retaining the slide 35 at a desired height as adjusted.

A sliding plate 40 is adjustably mounted on the slide 35, extending transversely over the slide 35. The slide 35 has a pair of parallel first slots 35*b*, 35*b* extending longitudinally of the printing apparatus 31, and the sliding plate 40 has a pair of second slots 40*a*, 40*a* extending across the first slots 35*b*, 35*b*, respectively, as viewed in plan. A screw 41 extends through the first and second slots 35*b*, 40*a* of each crossing pair at their intersection for fastening the slide 35 and the sliding plate 40 together. If the screw 41 is unfastened, the slide 40 can be moved by hand both longitudinally and transversely for adjustment.

The holder 30 includes a pair of mutually pivotable upper and lower outer frames 42, 43 for holding therebetween. The lower outer frame 43 is pivotally mounted on the slide 35 by a pivot 44 for supporting the inner frame 23 of the printing plate 24. The upper outer frame 42 is also pivotally mounted on the slide 35 by the pivot 44 for pressing the printing plate 24 so as to clamp the inner frame 23 between the upper and lower outer frames 42, 43.

Figure 2:
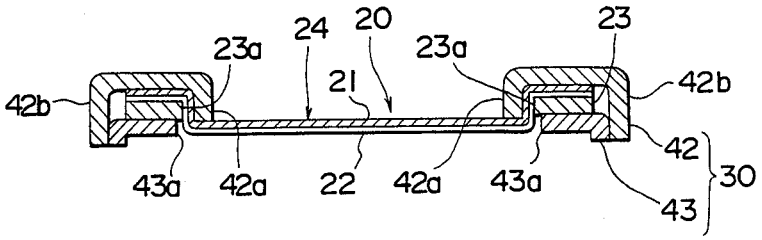
FIG. 2 is a transverse cross-sectional view of a printing-plate holder of the apparatus, showing the manner in which a printing plate is held by the holder.

The central opening of the lower outer frame 43 is slightly larger than the central opening of the inner frame 23 so that when the printing plate 24 is placed on the lower outer frame 43, an inner peripheral edge 23*a* of the inner frame 23 slightly projects inwardly from an inner peripheral edge 43*a* of the lower outer frame 43, as shown in FIG. 2. A pair of extension springs 44 is mounted between the lower outer frame 43 and the slide 35 so that the lower outer frame 43 is prevented from being easily lowered after having been raised. A pair of adjusting screws 46, 46 is mounted on the rear end portion of the base 32 and threadedly extends through a pair of cutouts 43*b*, 43*b*, respectively, so that the height of the rear end of the lower outer frame 43 relative to the base 32 can be determined as desired by turning these adjusting screws 46, 46. Designated by 47 is a catch 47 for catching the rear end of the upper outer frame 42 so as to retain the upper outer frame 42 with respect to the lower outer frame 43.

The upper outer frame 42 serves as a presser to stretch the screen master 20 with an appropriate degree of tension. For this purpose, as shown in FIG. 2, the upper outer frame 42 has a downwardly (inwardly) bent inner peripheral edge 42*a* along the entire circumstance of the upper outer frame 42 for pushing the screen master 20 downwardly toward the lower outer frame 43 as the screen master 20 is held between the upper and lower outer frames 42, 43. This inner peripheral edge 42*a* is disposed inwardly of at least the inner peripheral edge 23*a* of the inner frame 23. The upper outer frame 42 also has a pair of downwardly (inwardly) bent lateral outer edges 42*b*, 42*b*, the inside distance of which is substantially equal to the width of the lower outer frame 43. The height of the inner peripheral edge 42*a* of the upper outer frame 42 may be determined as desired. However, in the illustrated embodiment, the height of the inner peripheral edge 42*a* is slightly larger than the thickness of the inner frame 23.

For printing, the upper outer frame 42 is pulled upwardly, and then the processed printing plate 24 with the inner frame side down is placed on the lower outer frame 43. Subsequently, the upper outer frame 42 is lowered to press the printing plate 24 against the lower outer frame 42, 43. At that time the inner peripheral edge 42*a* of the upper outer frame 42 pushes the screen master 20 at portions near and along the inner frame 23 downwardly toward the lower outer frame 43 to stretch the screen master 20 with an appropriate degree of tension.

Thereafter, a print paper or any other object on which the image of the picture of the original 27 is to be printed is placed on the support table 33 on the base 32, and the position of the printing plate 24 is adjusted in conformity with the height of the upper surface of the print paper or object. Specifically, the height of the holder 30 is adjusted by turning the adjusting screws 37, 46, and the position of the image of the printing plate 24 with respect to the upper surface of the print paper or object is adjusted by shifting the sliding plate 40 longitudinally and transversely of the printing apparatus 31. Finally, an amount of ink is spread over the screen 21 of the screen master 20 within the upper outer frame 42 by a squeegee. Because the screen master 20 is stretched with an appropriate degree of tension, the image exactly formed on the screen master 20 during the plate-making step can be printed on the print paper or object with fidelity.

Further, with the printing apparatus 31, since the holder 30 can be adjusted also in height, it is possible to make a print not only on a thin paper but also on the upper surface of a solid object having a considerable height.

Since the holder of the present printing apparatus includes a lower outer frame for supporting the inner frame of the printing plate, and an upper outer frame having a downwardly bent inner peripheral edge for pushing the screen master from the side opposite to the inner frame toward the lower outer frame, it is possible to stretch the screen master with appropriate tension while printing.

Because the inner frame is attached to the film side of the screen master, the screen master is free from relaxing during the plate-making and can be stretched with an appropriate degree of tension when pressed during the printing.

Many modifications and variations of the present invention are possible in the light of the foregoing teachings. It is therefore to be understood that within the scope of the appended claims, the invention may be proacticed otherwise than as specifically described.

What is claimed is:

1. A screen printing apparatus for a printing plate having an inner frame with a central opening and a screen master mounted over the inner frame, comprising:

a base having a central portion where an object on which a print is to be made is to be received, a lower outer frame pivotally mounted on said base for supporting said printing plate on a side of the inner frame, said lower outer frame having a central opening larger than the central opening for said inner frame, and an upper outer frame pivotally mounted on said base for pressing said printing plate against said lower outer frame so as to clamp said inner frame of the printing plate between said upper and lower outer frames, said upper outer frame having a downwardly bent inner peripheral edge adapted to be disposed inwardly of at least said inner peripheral edge of said inner frame so that when said printing plate is held between said upper and lower outer frames, said inner peripheral edge of said upper outer frame pushes said screen master from its screen side at portions near and along said inner frame downwardly toward said lower outer frame to stretch said screen master at an appropriate degree of tension.

2. A screen printing apparatus according to claim 1, in which said upper outer frame further includes a pair of downwardly bent lateral outer edges, the inside distance between said lateral outer edges being substantially equal to the width of said lower outer frame.

3. A screen printing apparatus according to claim 1, further comprising a support table mounted on said central portion of said base for supporting the object which is in the form of a sheet.

4. A screen printing apparatus according to claim 1, further comprising a pair of brackets adjustably mounted on said base diametrically of said central portion for clamping the object which is in the form of a solid body.

5. A screen printing apparatus according to claim 1, in which said printing plate comprises a screen master composed of a thermoplastic synthetic resin film and a porous screen stuck together, and an inner frame attached to said screen master on its film side.

6. A screen printing apparatus for a printing plate with a screen master and an inner frame comprising, a base having a central portion where an object on which a print is to be made is to be received, a lower outer frame mounted on said base for supporting said printing plate on a side of the inner frame, an upper outer frame mounted on said base for pressing said printing plate against said lower outer frame so as to clamp said inner frame of the printing plate between said upper and lower outer frames, said upper outer frame having a downwardly bent inner peripheral edge for pushing said screen master of the printing plate from its screen side as said printing plate is held between said upper and lower outer frames, a height adjusting means including a pair of upright posts mounted on one end portion of said base, a slide vertically movably mounted on said posts, and means for retaining the slide at the desired position relative to the upright posts, and a longitudinal and transverse position adjusting means adjustably connected to the slide of the height adjusting means, said upper and lower outer frames being pivotally connected to the longitudinal and transverse position adjusting means.

7. A screen printing apparatus according to claim 6, in which said means for retaining the slide at a desired position includes a bridge plate extending between upper ends of said posts, an adjusting screw rotatably supported between said bridge plate and said base, a knob mounted on an upper end of said adjusting screw for turning said adjusting screw, and a retainer nut threadedly mounted on said adjusting screw for retaining said slide at an adjusted height.

8. A screen printing apparatus according to claim 7, in which said longitudinal and transverse position adjusting means includes a pair of parallel first slots formed on the slide and extending longitudinally of said base, a sliding plate adjustably mounted on said slide and having a pair of second slots extending perpendicularly to said first slots, and a pair of screws each extending through said first and second slots at their intersection for fastening said slide and said sliding plate together, said upper and lower outer frames being pivotally connected to the sliding plate.

9. A screen printing apparatus according to claim 8, in which said height adjusting means further includes a pair of additional adjusting screws threadedly extending through a rear portion of the lower outer frame to be mounted on the base.

10. A screen printing apparatus according to claim 9, in which said sliding plate has a pivot for pivotally supporting the upper and lower outer frames.

11. A combination of a screen printing apparatus and a printing plate, comprising, a printing plate including a screen master composed of a thermoplastic synthetic resin film and a porous screen stuck together; and an inner frame with a central opening attached to said screen master on its film side, and a screen printing apparatus including a base having a central portion where an object on which a print is to be made is to be received; a lower outer frame pivotally mounted on said base for supporting said printing plate on a side of the inner frame, said lower outer frame having a central opening larger than a central opening of said inner frame; and an upper outer frame pivotally mounted on said base for pressing said printing plate against said lower outer frame so as to clamp said inner frame of the printing plate between said upper and lower outer frames, said upper outer frame having a downwardly bent inner peripheral edge which is disposed inwardly of at least said inner peripheral edge of said inner frame so that when said printing plate is held between said upper and lower outer frames,. said inner peripheral edge of said upper outer frame pushes said screen master from its screen side at portions near and along said inner frame downwardly toward said lower outer frame to stretch said screen master at an appropriate degree of tension.

* * * * *